US008091586B2

(12) United States Patent
Briggs

(10) Patent No.: US 8,091,586 B2
(45) Date of Patent: Jan. 10, 2012

(54) METHOD OF MANUFACTURING A VENTURI TUBE FOR A FUEL SYSTEM

(75) Inventor: Paul F. Briggs, Grand Blanc, MI (US)

(73) Assignee: Continental Automotive Systems US, Inc., Auburn Hills, MI (US)

( * ) Notice: Subject to any disclaimer, the term of this patent is extended or adjusted under 35 U.S.C. 154(b) by 1007 days.

(21) Appl. No.: 11/730,824

(22) Filed: Apr. 4, 2007

(65) Prior Publication Data

US 2007/0256749 A1 Nov. 8, 2007

Related U.S. Application Data

(60) Provisional application No. 60/789,824, filed on Apr. 5, 2006.

(51) Int. Cl.
*F15D 1/02* (2006.01)

(52) U.S. Cl. ..... 138/44; 264/523; 264/530; 264/531; 264/536

(58) Field of Classification Search ..... 138/44; 264/523, 530, 531, 536
See application file for complete search history.

(56) References Cited

U.S. PATENT DOCUMENTS 2,770,012 A * 11/1956 Bowerman ..... 264/269
2,790,463 A * 4/1957 Delano et al. ..... 138/44
2,967,796 A * 1/1961 Raffel ..... 156/194
3,138,827 A * 6/1964 Hamilton ..... 249/145
4,057,609 A * 11/1977 Uhlig ..... 264/530
4,213,932 A * 7/1980 Young ..... 264/236
4,318,214 A 3/1982 Dodson
4,744,748 A * 5/1988 Raines et al. ..... 431/353
6,024,129 A * 2/2000 Schima ..... 138/44
6,119,728 A * 9/2000 Seidel-Peschmann et al. . 138/26
6,357,483 B1 * 3/2002 Kobayashi ..... 138/40
7,114,525 B2 * 10/2006 Krieger et al. ..... 138/44
2005/0033237 A1 * 2/2005 Fentress et al. ..... 604/165.03

OTHER PUBLICATIONS

Search report and Written Opinion in PCT/US2007/008449, Sep. 20, 2007.

* cited by examiner

*Primary Examiner* — James Hook

(57) ABSTRACT

A method of manufacturing a venturi tube 10' having a certain fluid flow direction is provided. The method provides a first core member 11 in a mold. The first core member has a periphery and an end 21 of a certain size. A second core member 17 is provided in the mold upstream of the first core member. The second core member has a periphery and an end 22 with a size that is less than the certain size. At least a portion of the end of the second core member is disposed adjacent to at least a portion of the end of the first core member such that a step is defined between the first and second core members. Material is molded about the peripheries of the first and second core members such that the peripheries define a stepped fluid flow surface of a venturi tube, and so that any resulting flash occurs only in the certain flow direction.

17 Claims, 3 Drawing Sheets

METHOD OF MANUFACTURING A VENTURI TUBE FOR A FUEL SYSTEM

This application claims the benefit of the earlier filing date of U.S. Provisional Application No. 60/789,824, filed on Apr. 5, 2006, which is incorporated by reference herein in its entirety.

FIELD OF THE INVENTION

This invention relates to manufacturing a venturi tube used in vehicle fuel systems.

BACKGROUND OF THE INVENTION

Venturi tubes are used in fuel supply modules of vehicles. For example, U.S. Pat. No. 6,951,208 shows a system having a reservoir that is disposed in a vehicle's fuel tank. A fuel pump is provided in the reservoir for pumping fuel from the reservoir to the engine of the vehicle. The fuel pump also operates a jet pump that draws fuel from the tank into the reservoir to ensure that the reservoir is replenished with fuel. The jet pump includes a venturi tube associated with a nozzle in the conventional manner to draw fuel through a jet valve into the reservoir.

It is important that the venturi tube has a smooth internal surface (flow surface) for optimum fluid flow through the tube. A typical manufacturing method to mold a venturi tube 10 is shown in FIG. 1. Based on the geometry of the tube 10, core pins and are required to enter a mold from both ends 12, 14 such that the two core pins and mate with each other at a mating location A. At the mating location A, flash can occur, causing the flow surface 16 to no longer be smooth, but to have a small wall protruding into the fluid path. The direction of fluid flow is indicted by arrow B.

Thus, there is need to provide a method of manufacturing a venturi tube with a flow surface that does not interrupt fluid flow in the flow direction.

SUMMARY OF THE INVENTION

An object of the invention is to fulfill the need referred to above. In accordance with the principles of the present invention, this objective is achieved by providing a method of manufacturing a venturi tube having a certain fluid flow direction provided. The method provides a first core member in a mold. The first core member has a periphery and an end of a certain size. A second core member is provided in the mold upstream of the first core member. The second core member has a periphery and an end with a size that is less than the certain size. At least a portion of the end of the second core member is disposed adjacent to at least a portion of the end of the first core member such that a step is defined between the first and second core members. Material is molded about the peripheries of the first and second core members such that the peripheries define a stepped fluid flow surface of a venturi tube, and so that any resulting flash occurs only in the certain flow direction. The first and second core members are then removed from the mold.

In accordance with another aspect of the invention, a venturi tube having a certain fluid flow direction includes a molded body having opposing ends. The body defines a substantially annular fluid flow surface extending continuously between the ends. The fluid flow surface includes a step such that any flash material, resulting during molding of the body, occurs near the step and only in the certain flow direction so as to not interrupt flow of fluid when flowing through the venturi tube in the certain flow direction.

Other objects, features and characteristics of the present invention, as well as the methods of operation and the functions of the related elements of the structure, the combination of parts and economics of manufacture will become more apparent upon consideration of the following detailed description and appended claims with reference to the accompanying drawings, all of which form a part of this specification.

BRIEF DESCRIPTION OF THE DRAWINGS

The invention will be better understood from the following detailed description of the preferred embodiments thereof, taken in conjunction with the accompanying drawings, wherein like reference numerals refer to like parts, in which.

DETAILED DESCRIPTION OF THE EXEMPLARY EMBODIMENT

Figure 1:
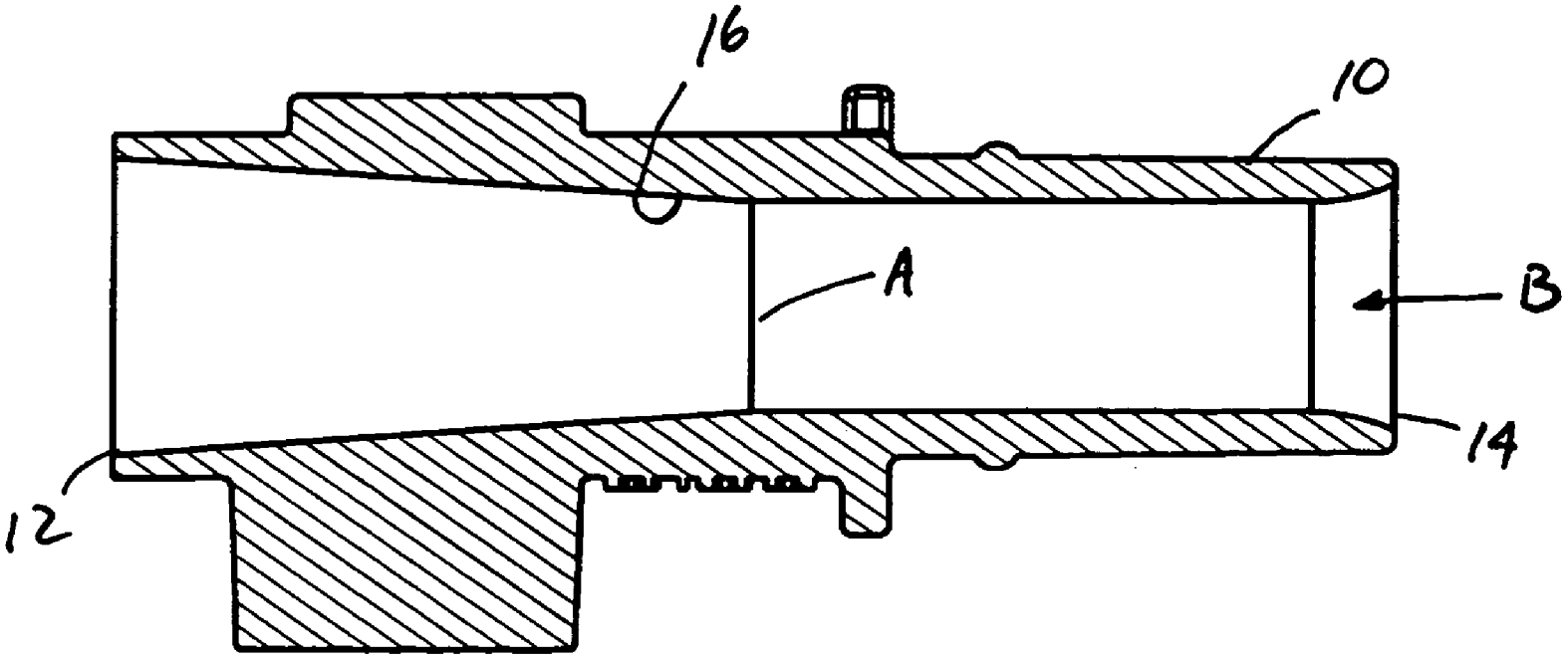
FIG. 1 (Prior Art)
FIG. 1 is a sectional view of the manufacture of a conventional venturi tube showing core pins for forming a flow surface of the venturi tube.
Figure 2:
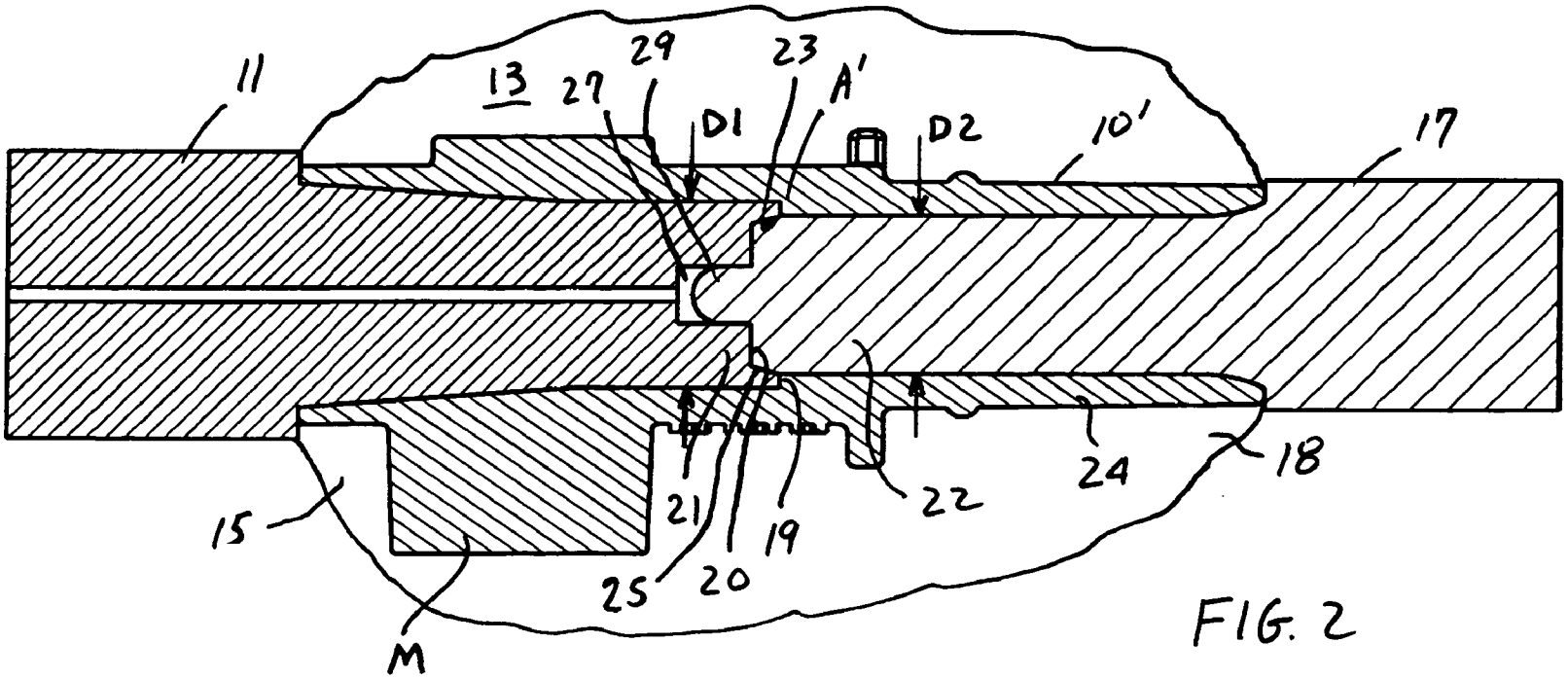
FIG. 2 is a sectional view of the manufacture of a venturi tube showing core pins in a mold for forming a flow surface of the venturi tube in accordance with an embodiment of the invention.
Figure 3:
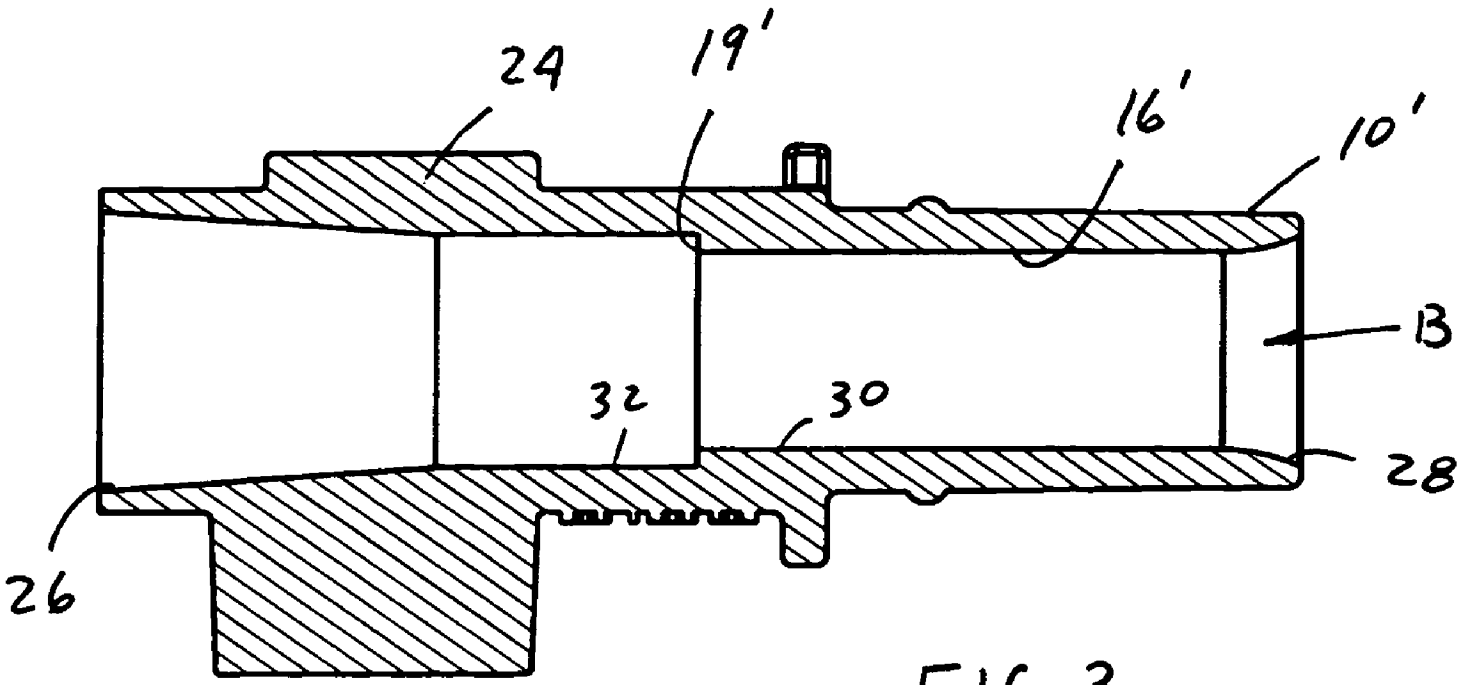
FIG. 3 is a sectional view of the molded venturi tube of FIG. 2 with core pins and mold removed.

Referring to FIG. 2 of the drawings, manufacture of a venturi tube 10' in accordance with an embodiment of the invention will be appreciated. To form a flow surface 16' (see FIG. 3) of the venturi tube 10', a generally cylindrical first core member or pin 11 is provided at one end 15 of a mold 13 and a generally cylindrical second core member or pin 17 is provided at the other end 18 (upstream of pin 15) of the mold 13 so that the core pins mate near a center of the tube 10' to be molded.

To prevent the risk of flash entering the fluid flow path near A', a step 19 is created between the peripheries of the core pins 11 and 17. In the embodiment, the step 19 is defined by the core pin 17 entering core pin 11. The mating end 21 of core pin 11 has an outer diameter D1 that is larger than an outer diameter D2 of the mating end 22 of the core 17.

With reference to FIG. 2, end 21 of the core pin 11 includes a surface defining a recess 20 that receives at least a portion of the mating end 22 of the core pin 17. In the embodiment, the recess 20 includes a taper 23 for ease of receiving and aligning with a mating taper 25 of end 22 of the core pin 17. In the embodiment of FIG. 2, the core pin 11 includes a second recess 27 receiving another portion 29 of end 22 of core pin 17.

Thus, as material M is molded about the core pins 11 and 17, the step 19' (FIG. 3) allows for any flash to only be in the direction of the fluid flow B, so that fluid flow is not disrupted when fluid flows in direct B through the tube 10'. Hence, when the core pins 11 and 17 are removed from the mold 13, the body 24 of the tube 10' includes a substantially annular flow surface 16' extending continuously between the ends 26, 28 of the body 24, with the substantially annular flow surface 16' having the step 19' therein. Thus, the fluid flow surface 16' is defined by a reduced diameter portion 30 and a diameter portion 32 that is larger than the reduced diameter portion, with the step 19' defining a transition between the diameter portions.

Although the embodiment shows the core pin 17 being received in a recess in core pin 11, it can be appreciated that instead, at least the outer ends of the core pins 11 and 17 can be planar and simply abut to define the step 19.

The foregoing preferred embodiments have been shown and described for the purposes of illustrating the structural and functional principles of the present invention, as well as illustrating the methods of employing the preferred embodiments and are subject to change without departing from such principles. Therefore, this invention includes all modifications encompassed within the spirit of the following claims.

What is claimed is:

1. A method of manufacturing a venturi tube having a certain fluid flow direction, the method including the steps of:

providing a first core member in a mold, the first core member having a periphery and a first end of a certain size, providing a second core member in the mold upstream of the first core member and on a common axis with the first core member, the second core member having a periphery and a first end with a size that is less than the certain size, at least a portion of the first end of the second core member being disposed adjacent to at least a portion of the first end of the first core member such that a substantially 90° step is defined between the first and second core members, the periphery of the first core member tapering outwardly to a second end of the first core member so that the second end of the first core member is sized larger than a second end of the second core member, molding material about the peripheries of the first and second core members such that the peripheries define a stepped fluid flow surface of a venturi tube, and so that any resulting flash occurs only in the certain flow direction, and so that an opening at an exit end of the venturi tube, defined by the second end of the first core member, is sized larger than an opening at an inlet end of the venturi, defined by the second end of the second core member, and removing the first and second core members from the mold.

2. The method of claim 1, wherein the first end of the first core member defines a recess and the step of providing the second core member includes receiving at least a portion of the first end of the second core member in the recess to define the step.

3. The method of claim 2, wherein the recess includes a taper and the first end of the second core member includes a mating taper.

4. The method of claim 2, wherein the first core member includes a second recess in the first end thereof, the method including receiving another portion of the first end of the second core member in the second recess.

5. The method of claim 1, wherein the first and second core members are each generally cylindrical pins, an outer diameter of the first end of the first core member is greater than an outer diameter of the first end of the second core member.

6. The method of claim 1, further comprising:

incorporating the venturi tube in a jet pump of a fuel supply module.

7. A venturi tube having a certain fluid flow direction obtained by the process comprising the steps of:

providing a first core member in a mold, the first core member having a periphery and a first end of a certain size, providing a second core member in the mold upstream of the first core member and on a common axis with the first core member, the second core member having a periphery and a first end with a size that is less than the certain size, at least a portion of the first end of the second core member being disposed adjacent to at least a portion of the first end of the first core member such that a substantially 90° step is defined between the first and second core members, the periphery of the first core member tapering outwardly to a second end of the first core member so that the second end of the first core member is sized larger than a second end of the second core member, molding material about the peripheries of the first and second core members such that the peripheries define a stepped fluid flow surface of a venturi tube, and so that any resulting flash occurs only in the certain flow direction, and so that an opening at an exit end of the venturi tube, defined by the second end of the first core member, is sized larger than an opening at an inlet end of the venturi tube, defined by the second end of the second core member, and removing the first and second core members from the mold.

8. The venturi tube of claim 7, wherein the first end of the first core member defines a recess and the step of providing the second core member includes receiving at least a portion of the first end of the second core member in the recess to define the step.

9. The venturi tube of claim 8, wherein the recess includes a taper and the first end of the second core member includes a mating taper.

10. The venturi tube of claim 8, wherein the first core member includes a second recess in the first end thereof, another portion of the first end of the second core member being received in the second recess.

11. The venturi tube of claim 10, the fluid flow surface is defined by a reduced diameter portion and a diameter portion that is larger than the reduced diameter portion, with the step defining a transition between the diameter portions.

12. The venturi tube of claim 11, in combination with first and second core members for defining the fluid flow surface, the core members having mating ends, an end of the first core member being larger in diameter than a diameter of the end of the second core member.

13. The venturi tube of claim 12, wherein the first core member has a recess in the end and the end of the second core member is constructed and arranged to be received in the recess.

14. The venturi tube of claim 7, wherein the first and second core members are each generally cylindrical pins, an outer diameter of the first end of the first core member is greater than an outer diameter of the first end of the second core member.

15. The venturi tube of claim 7, in combination with a jet pump of a fuel supply module, the jet pump including the venturi tube.

16. A venturi tube having a certain fluid flow direction, the venturi tube comprising:

a molded body having opposing ends, the body defining a substantially annular fluid flow surface extending continuously between the ends, the fluid flow surface including a substantially 90° step such that any flash material, resulting during molding of the body, occurs near the step and only in the certain flow direction so as to not interrupt flow of fluid when flowing through the venturi tube in the certain flow direction, wherein the opposing ends define an inlet end and an exit end, the venturi tube having a portion that tapers outwardly to the exit end, with the exit end having an opening that is larger than an opening at the inlet end.

17. The venturi tube of claim 16, in combination with a jet pump of a fuel supply module, the jet pump including the venturi tube.

* * * * *